United States Patent [19]

Rossollin

[11] 4,213,378

[45] Jul. 22, 1980

[54] METHOD AND APPARATUS FOR REMOVING WASTE PIECES FROM A PRE-CUT SHEET

[75] Inventor: Jean-Claude Rossollin, Chamonix-Mont-Blanc, France

[73] Assignee: United Patents Trust Reg.-U.P.T., Vaduz, Liechtenstein

[21] Appl. No.: 912,011

[22] Filed: Jun. 2, 1978

[51] Int. Cl.[3] ..... B31B 1/74

[52] U.S. Cl. ..... 93/36 A; 83/103; 93/59 ES

[58] Field of Search ..... 93/36 A, 59 ES; 83/103

[56] References Cited

U.S. PATENT DOCUMENTS

| | | | |
|---|---|---|---|
| 3,103,961 | 9/1963 | Milligan | 83/103 X |
| 3,877,353 | 4/1975 | Smith et al. | 93/36 A |
| 3,964,655 | 6/1976 | Kotaro | 93/59 ES |

FOREIGN PATENT DOCUMENTS

| | | | |
|---|---|---|---|
| 1809449 | 6/1970 | Fed. Rep. of Germany | 93/36 A |

*Primary Examiner*—Robert D. Baldwin

*Attorney, Agent, or Firm*—Gerlach & O'Brien

[57] ABSTRACT

A method for removing waste pieces from a pre-cut sheet having cut portions and waste pieces therein, includes the steps of conveying the sheet and stripping needles along respective substantially parallel rectilinear paths and at the same rate of travel, impaling the waste pieces on the needles during the conveying step, and thereafter separating the waste pieces by moving the needles rotatively relative to the cut portions. Apparatus for performing the method includes conveyor means for the sheet and a link chain having the needles mounted on its links, for conveying the sheet and the needles in the aforesaid manner with the needles facing the sheet, means for moving the sheet laterally during such conveyance to impale it on the needles, and roller means mounting the chain at the upstream and downstream ends of the rectilinear path followed by the needles, to provide curved paths for the needles thereat and thereby effect the separation of the waste pieces at the downstream end and preimpalement thereof at the upstream end.

8 Claims, 7 Drawing Figures

METHOD AND APPARATUS FOR REMOVING WASTE PIECES FROM A PRE-CUT SHEET

The present invention relates to a method of removing waste pieces from a pre-cut sheet having useful cut portions and waste pieces therein, especially a sheet of cardboard, in which the waste pieces are impaled on stripping needles, and the needles are subjected to a rotational or rocking movement to separate the waste pieces from the cut portions.

The invention also relates to apparatus for carrying out the foregoing method.

The removal of waste pieces from pre-cut sheets, especially from sheets of cardboard to be used in the manufacture of folding boxes, that is to say the separation of the waste pieces from the useful cut portions, or box blanks, presents problems. Presently, three principal methods of removing waste pieces are known, i.e.:

(1) Removal of waste pieces by means of a machine which is independent of the press serving to pre-cut the sheet. The method is expensive, requiring operations in successive stages, first in the machine for pre-cutting and secondly in a machine serving exclusively for waste removal.

(2) Removal of waste pieces integrated with the pre-cutting. With this method, it is often difficult to remove the waste entirely from the sheet, since it is necessary to maintain sufficient integrity in the sheet to enable it to be driven up to the receiving station of the machine. The tooling for the waste removal is expensive. Moreover, the speed of operation of the pre-cutting press must be reduced due to the reduced stability of steadiness of the sheet following removal of waste pieces therefrom.

(3) Removal of waste pieces from pre-cut bands in a continuous way by means of discs and rotative needles. According to this method, rollers are employed which are provided with points or needles which impale the waste pieces and pull then downwards while the cut portions remain in the band. This method is possible only with bands and not with sheets, since it does not permit any transfer of dimensions. The impalement of the waste pieces is not precise since the rollers which carry the needles are rotated while the advance of the band is linear. Moreover, this method permits the removal of but a portion of the waste pieces, in the case of a complicated pre-cutting, since, as in the foregoing method No. 2, it is necessary that the pre-cut band maintain some stability.

An object of the present invention is to overcome the foregoing problems.

The method according to the invention is characterized by the fact that, during the impalement of waste pieces, translational motion is imparted to the stripping needles, parallel to the motion imparted to the pre-cut sheet, so that the needles and the said sheet move exactly at the same speed, and once the impalement is effected, the aforesaid rotational or rocking motion is imparted to the needles.

Apparatus according to the invention, for carrying out the foregoing method, which apparatus includes means for advancing the pre-cut sheet, is characterized by the inclusion of an endless chain the links of which carry outwardly extending stripping needles, the arrangement being such that the impalement of the waste pieces is effected when the sheet is situated opposite a rectilinear portion of the said endless chain situated between two rotatable members which support the chain at opposite ends of the rectilinear portion, the chain and the sheet advancing in parallel at the same speed during the impalement, and the removal of waste pieces is effected when the needles having the waste pieces impaled thereon rotate on the rotatable supporting member situated downstream with respect to the direction of advance of the chain.

The drawings illustrate, by way of example, embodiments of the method and apparatus of the invention.

Figure 1:
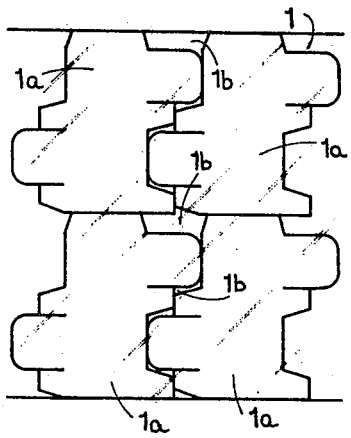
FIGS. 1 and 2 are plan views of a portion of two sheets which have been pre-cut according to different modes of pre-cutting.
Figure 2:
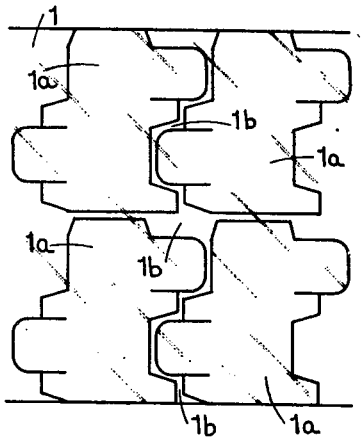

Two types of pre-cutting of sheets, especially of cardboard, are distinguished: first, pre-cutting with a common cut, as represented in FIG. 1, where the sheet is designated by the reference symbol 1, and where the cut portions, designated by the reference symbol 1*a*, are in contact with each other. The waste pieces, designated by the reference symbol 1*b*, are situated between the cut portions at the places where the profiles of two neighbouring cut portions are not adjacent. The second type is pre-cutting with a double cut, wherein the cut portions are never in contact with each other, as represented in FIG. 2, where the cut portions have also been designated by the reference symbol 1*a* and the waste pieces by the reference symbol 1*b*.

It is to be noted that, in each case, the cut portions may be cut within their boundaries, to provide openings therein upon removal of the waste pieces resulting therefrom, during the removal of the remaining waste pieces.

Figure 3:
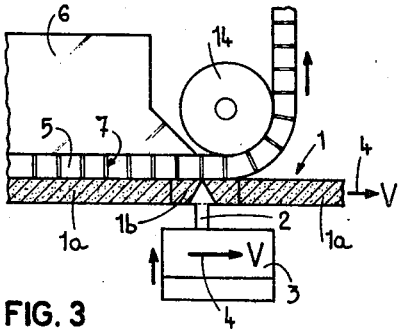
FIGS. 3, 4 and 5 illustrate diagrammatically three successive steps in one embodiment of the method.
Figure 4:
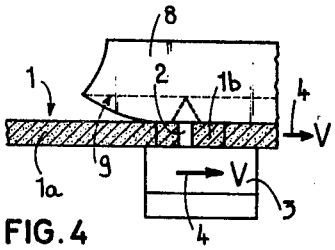
Figure 5:
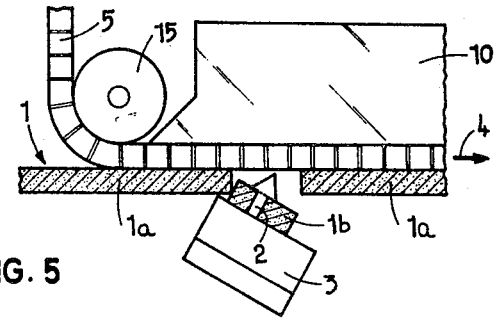

The three main steps or stages in the method of removing waste pieces are represented in FIGS. 3, 4 and 5, respectively:

Stripping needles 2, only one of which is represented, carried by the links 3 of an endless chain, only one of which links is represented, are conveyed in the direction of the arrow 4 at a speed V, along a rectilinear path or in translational motion. The height of the upper part of the endless chain is such that, at the moment where each link 3 reaches this upper part, the needles carried by the link engage slightly, in an operation of pre-impalement or pre-stretching, into a waste piece 1*b* of the pre-cut sheet 1 (see also FIG. 1). This sheet also is conveyed along a rectilinear path in the direction of the arrow 4 and at the speed V, by a conveyor belt or first belt 5. The first belt 5 passes in front of a suction or vacuum chamber or box 6 which, acting through passages 7 provided in the said belt, serves to hold the sheet 1 against the belt as it is conveyed along an upstream portion of the latter path.

The needles 2 and the sheet 1 continue their advance at the same speed, the sheet passing next under an abutting cam shoe 8 in engagement therewith. The shoe 8 is provided with longitudinal grooves 9, and its lower face is situated slightly lower than the face of the first belt 5 in contact with the sheet. Consequently, the sheet 1 is cammed slightly laterally or downwardly, for a distance on the order of one millimeter, which causes the needles 2 to impale the waste pieces 1*b*, and the ends of the needles 2 to enter into the longitudinal grooves 9 of the shoe 8 (FIG. 4), to complete the impalement of the pieces.

In the foregoing manner, the pre-impalement and the impalement are effected while the needles 2 and the pre-cut sheet 1 are conducted along substantially parallel rectilinear paths and at the same rate of travel.

It is only when the impalement is complete that the separating, stripping, or tearing out of the waste pieces 1*b* is effected by a rotative or rocking movement of the link 3 of the chain, and thereby also of the needles 2, the sheet 1 and particularly the cut portions 1*a* being then also subjected to the action of a suction or vacuum chamber or box 10 (see FIG. 5) while being conveyed along a downstream portion of the aforesaid rectilinear travel path thereof. Thus, during the rotative movement, a force opposed to the force exerted by the needles 2 on the waste pieces 1*b* is exerted on the cut portions 1*a* of the sheet 1.

Figure 6:
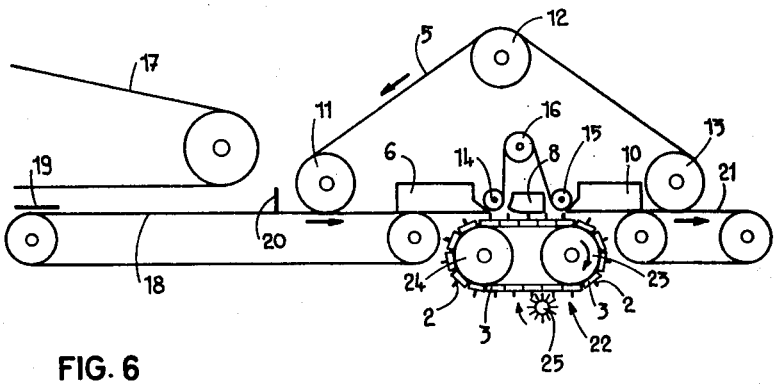
FIG. 6 is a diagrammatic elevational view of one embodiment of the apparatus.
Figure 7:
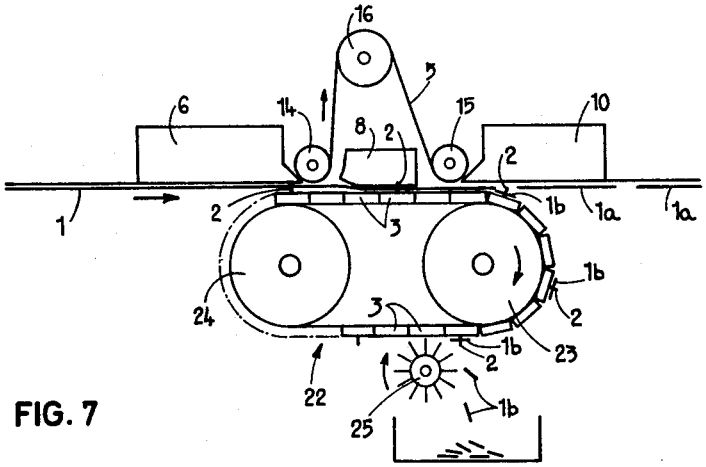
FIG. 7 is an enlarged detail view of a portion of the apparatus embodiment.

FIGS. 6 and 7 show, diagrammatically, an embodiment of apparatus adapted to carry out the foregoing method:

The first belt 5 is trained on three rollers 11, 12 and 13, one of which, for instance roller 13, is a drive roller. It is trained moreover on three intermediate rollers 14, 15 and 16 which maintain it away from the sheet 1 which is undergoing impalement of its waste pieces 1*b*. The sheets 1 which are worked are fed by a second belt 17 which is located at the very output of the press in which has been effected the pre-cutting, on a conveyor belt or third belt 18 driven by the first belt 5. The sheets rest by their rear portion on a sustaining fourth belt 19 and are maintained, at their front part, by retractable blocks 20. At their discharge from the apparatus, the sheets and particularly the cut portions 1*a* are removed by a conveyor belt or fifth belt 21 also driven by the first belt 5.

The apparatus includes an endless chain 22 constituted by a succession of the links 3 articulated to each other and carrying the stripping needles 2. This endless chain rotates on two rollers 23 and 24 one of which, for instance roller 23, is a drive roller. The chain 22 is driven by the roller 23 to convey the needles 2 along a rectilinear path and at a speed V (FIGS. 3 and 4) as aforesaid, in the direction of the arrow 4 between the upstream roller 24 and the downstream roller 23. The rollers 24 and 23 support the chain 22 to provide a curved path of travel for the needles 2 therearound at each of the upstream end of the latter path and the downstream end thereof, respectively. The pre-impalement corresponding to the operation diagrammatically represented in FIG. 3 is effected when the sheet 1 which is worked is situated opposite the suction chamber 6 while the impalement itself, corresponding to the operation of FIG. 4, is effected when the sheet is situated opposite the shoe 8 which presses the sheet against the chain 22. Then the separation or tearing out of the waste pieces, corresponding to the operation of FIG. 5, is effected when the sheet is situated opposite the suction chamber 10, at the place where the links 3 commence to rotate around the downstream roller 23.

The apparatus includes a metallic rotatable brush 25, rotating in a direction counter to the direction of displacement of the chain 22, to remove from the needles 2 the waste pieces 1*b* impaled thereon.

The links are arranged in such a way that the needles 2 can be secured thereto removably. This allows the needles to be placed on the links at locations corresponding to the pattern of the pre-cut sheet. This is the reason for which, in FIG. 7, all the links 3 have not been represented as provided with needles.

It is to be noted that it is necessary, so that the impalement is effected correctly, not only that the sheet 1 and the needles 2 move exactly at the same speed, but also that the sheets and the chain 22 occupy a relative position which is perfectly determined, as is ensured by the movable blocks 20. These blocks will retract in a movement which is synchronised with the movement of the chain 22, so as to release a sheet at the precise moment when the chain occupies a position such that its first needles 2 engage the first waste pieces of the sheet.

The apparatus can be provided, at its output, with driving drums acting on the waste-free sheets to submit them to a slight traction, their speed being slightly higher than that of the fifth belt 21, thereby to separate the cut portions 1*a* from each other, so that they go out of the machine perfectly ready for use.

Thus, the apparatus of the present invention operates to remove the waste pieces completely from the pre-cut sheets, whatever the dimension of the waste pieces may be, the cut portions being, at their discharge, ready for use, with no need for any complementary operation of waste removal. The apparatus may receive sheets having little stability as a result of pre-cutting, and it supplies them in perfect synchronism with the chain 22, for effecting the pre-impalement and the impalement while each sheet and the stripping needles are moved exactly at the same speed. The apparatus maintains the sheet while acting on the cut portions at the moment the waste removal is effected, and the cut portions may be separated from each other once the waste removal is effected.

I claim:

1. In a method of removing waste pieces from a pre-cut sheet having cut portions and waste pieces therein, which method includes the steps of impaling the waste pieces on stripping needles and separating the waste pieces from the cut portions by moving the needles rotatively relative to the cut portions, the improvement which comprises carrying out said impaling step while conveying said sheet and said needles along respective substantially parallel rectilinear paths and at the same rate of travel, and thereafter carrying out said separating step while applying suction to said cut portions, said application of suction causing a force to be exerted on said cut portions in opposition to the force exerted on said waste pieces by said needles during the separating step.

2. A method as defined in claim 1 wherein said needles are carried on links of an endless chain conducted along said rectilinear path of the needles during said impaling step, and said chain conveys said needles in a curved path which passes around a roller to effect said separating step.

3. A method as defined in claim 1 wherein said sheet is moved laterally against said needles to effect said impaling step.

4. A method as defined in claim 1 wherein said needles are carried on links of an endless chain conducted along said rectilinear path of the needles during said impaling step, and said chain conveys said needles in curved paths which pass around a pair of rollers and which merge with the latter path at respective upstream and downstream ends thereof, whereby said waste pieces are pre-impaled on said needles at the upstream end and said separating step is effected at the downstream end, and said sheet is moved laterally against said needles to effect said impaling step.

5. A method as defined in claim 1, 2, 3, or 4 wherein said sheet is made of cardboard.

6. In apparatus for removing waste pieces from a pre-cut sheet having cut portions and waste pieces therein, the improvement comprising:

means for conveying such a sheet along a first substantially rectilinear path, an endless link chain mounted for travel along a second substantially rectilinear path which is substantially parallel to said first path, a plurality of stripping needles mounted on the links of said chain for being conveyed thereby and projecting outwardly therefrom, means for driving said chain to convey said needles along said second path at the same rate of travel as such a sheet is being conveyed along said first path, said needles projecting towards said first path while being conveyed along the second path, means for moving such sheet laterally against said needles to impale said waste pieces on the needles while the sheet and the needles travel at the same rate in said first and second paths, respectively, means for conveying said cut portions of such sheet along a portion of said first path extending downstream beyond a downstream end of said second path, roller means mounting said chain to provide a curved path of travel for said needles therearound at said downstream end, whereby said impaled waste pieces are separated from said cut portions while the cut portions are conveyed along said first path and the needles are conveyed along said curved path, and means for applying suction to said cut portions adjacent to said downstream end of the second path, thereby to cause a force to be exerted on said cut portions in opposition to the force exerted on said waste pieces by said needles being conveyed along said curved path.

7. In apparatus for removing waste pieces from a pre-cut sheet having cut portions and waste pieces therein, the improvement comprising:

means for conveying such a sheet along a first substantially rectilinear path, an endless link chain mounted for travel along a second substantially rectilinear path which is substantially parallel to said first path, a plurality of stripping needles mounted on the links of said chain for being conveyed thereby and projecting outwardly therefrom, means for driving said chain to convey said needles along said second path at the same rate of travel as such a sheet is being conveyed along said first path, said needles projecting towards said first path while being conveyed along the second path, means for moving such sheet laterally against said needles to impale said waste pieces on the needles while the sheet and the needles travel at the same rate in said first and second paths, respectively, roller means mounting said chain to provide a curved path of travel for said needles therearound at each of an upstream end of said second path and a downstream end thereof, said means for conveying such sheet serving to convey the sheet along a portion of said first path extending upstream beyond said upstream end, whereby said waste pieces of such sheet are pre-impaled on said needles at said upstream end while the sheet is conveyed along said first path and the needles are conveyed from said curved path to said second path at said upstream end, means for conveying said cut portions of such sheet along a portion of said first path extending downstream beyond said downstream end, whereby said impaled waste pieces are separated from said cut portions while the cut portions are conveyed along said first path and the needles are conveyed along said curved path at said downstream end, and means for applying suction to said cut portions adjacent to said downstream end of the second path, thereby to cause a force to be exerted on said cut portions in opposition to the force exerted on said waste pieces by said needles being conveyed along said curved path at said downstream end.

8. Apparatus as defined in claim 6 or 7 wherein said sheet moving means comprises a cam shoe engaging such sheet on the side thereof remote from said needles.

* * * * *